United States Patent [19]

Ernat et al.

[11] Patent Number: 4,881,306

[45] Date of Patent: Nov. 21, 1989

[54] CASKET BED

[75] Inventors: John Ernat, Oxford, Miss.; Dennis C. Laphan, Batesville, Ind.

[73] Assignee: Batesville Casket Company, Inc., Batesville, Ind.

[21] Appl. No.: 354,824

[22] Filed: May 22, 1989

[51] Int. Cl.[4] ..... A63G 17/00

[52] U.S. Cl. ..... 27/12; 27/2

[58] Field of Search ..... 27/2–19, 27/35; 5/116–119, 190, 191; 297/42, 44, 45, 164

[56] References Cited

U.S. PATENT DOCUMENTS

| | | | |
|---|---|---|---|
| 404,639 | 6/1889 | Manning | 27/2 |
| 818,220 | 4/1906 | Belair | 27/11 |
| 1,261,707 | 4/1918 | Cook | 27/2 |
| 1,740,581 | 12/1929 | Eppihimer | 27/2 |
| 1,800,793 | 4/1931 | Harms | 27/2 |
| 1,840,675 | 1/1932 | Letzig | 27/2 |
| 1,934,425 | 11/1933 | Harms | 27/2 |
| 2,142,553 | 1/1939 | Benoit | 27/12 |
| 2,156,664 | 5/1939 | Litle, Jr. | 5/190 |
| 2,735,157 | 2/1956 | Hotchkiss et al. | 27/12 |
| 3,346,891 | 10/1967 | Cundiff | 5/191 X |
| 4,044,436 | 8/1977 | Patrick | 27/12 |
| 4,305,186 | 12/1981 | Cherry | 27/4 |

*Primary Examiner*—Richard E. Chilcot, Jr.

*Attorney, Agent, or Firm*—Wood, Herron & Evans

[57] ABSTRACT

A casket bed has a rectangular metal frame formed by inserting tongues projecting from some frame members into slots in the adjacent frame member. Bands of industrial strapping are wrapped horizontally and longitudinally about the frame to complete the formation of the bed.

8 Claims, 2 Drawing Sheets

CASKET BED

BACKGROUND OF THE INVENTION

This invention relates to a casket bed.

It has been customary to make a casket bed from a narrow (about 17 inches wide") metal frame. Within the metal frame is a body support consisting of either a wire fabric mesh or three to five metal bands which are about ¾ inch wide, the bands being stretched longitudinally across the frame. In both instances of the wire fabric mesh or the metal bands, 4 coil springs at one or both ends of the frame maintain the mesh or metal bands in a taut condition.

The disadvantages of the current casket beds are several.

One disadvantage is the noise that is produced by the metal members moving with respect to one another when the casket is transported from place to place. This is particularly objectionable when the noise intrudes on that part of a funeral service wherein the casket is removed from the place where the service is held.

Another disadvantage is the cost of manufacture arising out of the cost of the metal wire mesh fabric or bands, and the labor cost of assembly.

Still another disadvantage arises out of the need to modify the bed in order to accommodate bodies that have become modified due to advanced age or extended rest in a fetal position or the like. In such instances, the body support must be partly cut away in order to better position a body on the bed.

SUMMARY OF THE INVENTION

An objective of the present invention has been to provide an improved casket bed that is less expensive than those with metal patient support; that is quieter than those with metal patient support and that may be more easily modified to accommodate modification in body attitudes.

The objectives of the present invention are attained by providing a rectangular frame that is spanned longitudinally and transversely by bands of an industrial strapping that are wrapped around the frame. By industrial strapping is meant that high tensile, self-bonding low elongation polymer strapping which is about ⅜ inch to ½ inch wide and which is in widespread use to bind up packaging of industrial goods for shipment.

In the preferred embodiment of the invention, the frame is assembled without welding or riveting. Instead, certain frame members have tongues struck from their ends and the adjoining frame members have slots cut in their ends. The tongues project into the slots of adjacent frame members and are bent over upon the adjoining frame member to secure the members together. These frames are wrapped longitudinally and transversely with bands of industrial strapping under tension.

Each strap is strong enough to resist tension forces of in excess of 600 pounds. When tension is applied to the bands, preferably in the range of about 150 to 200 pounds, the bands not only provide the necessary body support, replacing the metal straps, mesh and springs, but securely bind the frame together.

Several advantages are derived from the structure of the present invention. There are significant economies. The strapping per se is less expensive than the metal mesh or metal straps and springs that have been used in the past. Further, there is a low labor cost in assembly arising in part out of the ability to use automatic machinery in applying the strapping. Because of the reduction in the cost of materials and labor, it is economically feasible to make the bed about 3 inches wider than has been practiced in the past, thereby providing more complete body support and assurance that the arms of the body do not fall between the frame and the casket shell.

There are advantages in the use of the bed according to the present invention. In the elimination of metal attached to metal, there is no possibility of metal noise when the casket is being moved from place to place.

The preferred attachment pattern of the strapping is three longitudinal straps and nine transverse straps. This provides full perimeter support and far more stable positioning of the deceased's body. More specifically, the design of the present invention provides 24 load bearing contact points between the bed frame and the strapping as contrasted to 6–10 contact points of the conventional metal mesh or bands.

The adjustment of the bed to accommodate the modified attitude of the deceased's body is greatly facilitated by the present invention. The funeral director can easily cut and remove selected strapping to create holes in the bed into which projecting portions of the deceased's body can be placed.

BRIEF DESCRIPTION OF THE DRAWINGS

The several features and objectives of the present invention will become more readily apparent from the following detailed description taken in conjunction with the accompanying drawings in which.

DETAILED DESCRIPTION OF THE INVENTION

Figure 1:
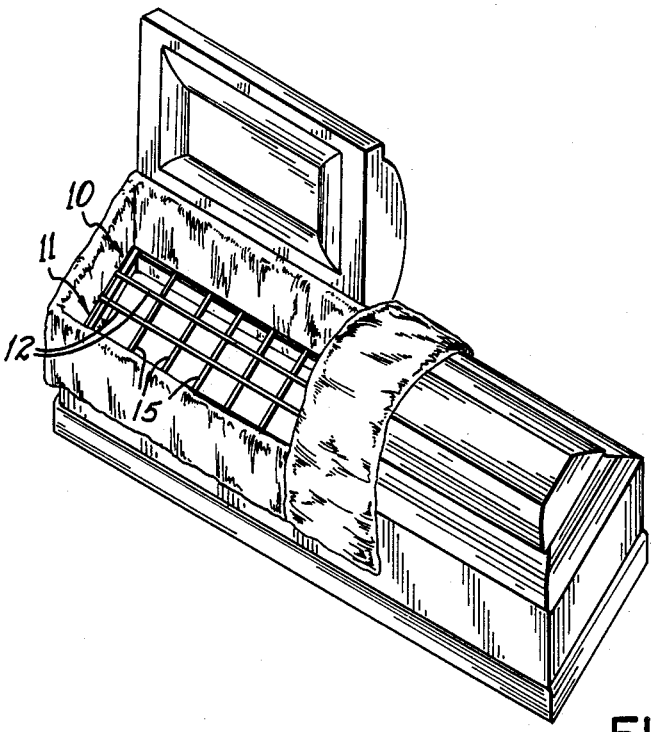
FIG. 1 is a perspective view of a casket containing a bed of the present invention.

Referring to FIG. 1, a casket bed 10 of the present invention has a rectangular metal frame 11 wrapped by three bands 12 of high tensile, self-bonding low elongation polymer, (e.g., polypropylene) strapping and nine bands 15 of such strapping in a transverse direction. The strapping is about ⅜ inch to ½ inch wide. For example, it can be applied by using the banding system designed by Gerrard & Company utilizing the Endura strapping heads. Each strap is wrapped about the frame with transverse straps first and thereafter longitudinal straps. Each strap is stressed by about 150 to 200 pounds of tension. With ends overlapped and tension applied, the ends are heat-sealed to each other to complete the assembly of each strap to the frame.

Figure 2A:
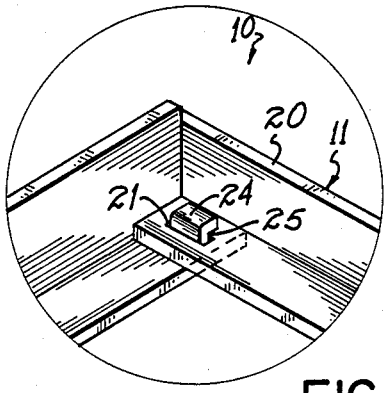
FIG. 2A is an enlarged view of the encircled area 2A–2A.
Figure 3:
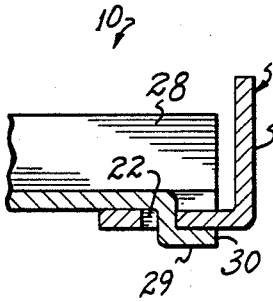
FIG. 3 is a cross-sectional view taken along lines 3—3 of FIG. 2.
Figure 2:
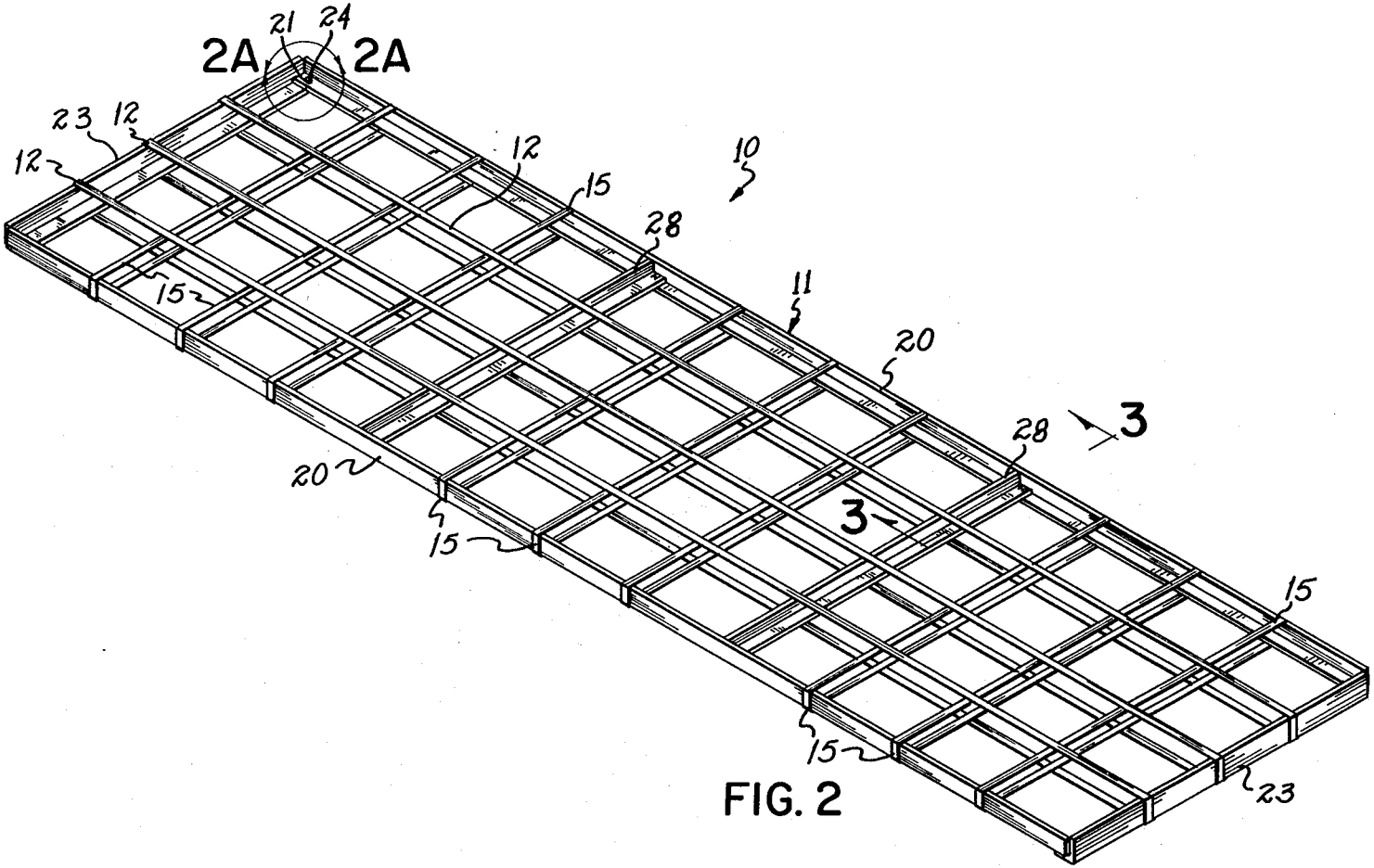
FIG. 2 is a perspective view of the bed of the present invention.

The frame has two longitudinal members 20, which are angle irons, each of which has slots 21 in its ends and two slots 22 intermediate the ends. At the ends of the frame 11 are angle irons 23 that have tongues 24 at their ends. The tongues 24 are inserted in the slots 21 of the longitudinal members and are pressed over the longitudinal members as shown at 25 in FIG. 2A to hold the members in assembled position until the strapping is applied. Two intermediate angle irons 28 have tongues 29 at their ends. The tongues 29 project through the slots 22 intermediate the ends of the longitudinal frame members and are pressed over as at 30 (see FIG. 3) to hold the members in assembled condition until the strapping is applied. The frame could be riveted or welded as is now conventional.

After the strapping is applied, under tension, the strapping holds the frame members together. The strapping also provides the body support. The plastic straps wrapped about metal frame members eliminates the metal-to-metal mounting of body support to the frame and, hence, the noise of it. Because of the elimination of any welding or riveting operations for the frame, and because of the capability of using automatic strapping machinery for wrapping the straps around the frame, significant savings in labor and material costs are derived from the invention.

In use, it can be seen that because of the multiple points of support provided, some of the points of support can be cut away to permit a body (rigid in a fetal position, for example) to be more gracefully positioned in a casket with very little effort on the part of the funeral director to make the accommodation.

From the above disclosure of the general principles of the present invention and the preceding detailed description of a preferred embodiment, those skilled in the art will readily comprehend the various modifications to which the present invention is susceptible. Therefore, we desire to be limited only by the scope of the following claims and equivalents thereof:

We claim:

1. A casket bed comprising:

a metal rectangular frame, a plurality of spaced polymeric straps wrapped longitudinally about said frame, and a plurality of spaced polymeric straps wrapped transversely about said frame.

2. A casket as in claim 1 in which the ends of each strap overlap and are heat-sealed to each other.

3. A casket as in claim 1 in which each strap is placed under tension.

4. A casket as in claim 1 in which each said strap is about $\frac{3}{8}$ inch to $\frac{1}{2}$ inch wide.

5. A casket as in claim 1 in which:

three straps extend longitudinally of the frame and nine straps extend transversely of the frame.

6. A casket bed comprising:

a rectangular frame of angle irons, said angle irons overlapping at the corners of said frame, at each corner, one of said angle irons having a slot and the other having a tongue projecting into said slot and bent over to lay against the adjoining angle iron, and polymeric straps wrapped longitudinally and transversely about said frame with ends overlapped and heat-sealed, said straps being under tension to keep said frame angle irons held tightly together and to prevent rattling.

7. The method of making a casket bed comprising the steps of:

forming a rectangular frame of angle irons, wrapping said frame longitudinally and transversely with spaced polymeric straps, overlapping and heat-sealing the ends of said straps.

8. The method of making a casket bed comprising:

forming a rectangular frame of angle irons, forming mating slots and tongues in adjoining ends of said angle irons, assembling said frame with tongues inserted in slots, bending said tongues to overlap a portion of the adjoining angle irons, wrapping said frame longitudinally and transversely with spaced polymeric straps, overlapping and sealing the ends of said straps while placing said straps under tension.

* * * * *